US011293072B2

(12) United States Patent
Zhang et al.

(10) Patent No.: US 11,293,072 B2
(45) Date of Patent: Apr. 5, 2022

(54) PROCESS FOR ON-LINE QUENCHING OF SEAMLESS STEEL TUBE USING RESIDUAL HEAT AND MANUFACTURING METHOD

(71) Applicant: BAOSHAN IRON & STEEL CO., LTD., Shanghai (CN)

(72) Inventors: Zhonghua Zhang, Shanghai (CN); Yaoheng Liu, Shanghai (CN); Ke Xu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 119 days.

(21) Appl. No.: 15/762,912

(22) PCT Filed: Sep. 21, 2016

(86) PCT No.: PCT/CN2016/099563

§ 371 (c)(1),
(2) Date: Mar. 23, 2018

(87) PCT Pub. No.: WO2017/050229

PCT Pub. Date: Mar. 30, 2017

(65) Prior Publication Data

US 2018/0265941 A1 Sep. 20, 2018

(30) Foreign Application Priority Data

| | | |
|---|---|---|
| Sep. 24, 2015 | (CN) | 201510615737.9 |
| Apr. 26, 2016 | (CN) | 201610265674.3 |
| Aug. 30, 2016 | (CN) | 201610776283.8 |

(51) Int. Cl.

| | |
|---|---|
| ***C21D 9/08*** | (2006.01) |
| ***C22C 38/04*** | (2006.01) |
| ***C22C 38/08*** | (2006.01) |
| ***C21D 11/00*** | (2006.01) |
| ***C22C 38/06*** | (2006.01) |
| ***B21B 19/04*** | (2006.01) |
| ***C21D 1/667*** | (2006.01) |
| ***C21D 1/18*** | (2006.01) |
| ***C21D 6/00*** | (2006.01) |
| ***C22C 38/00*** | (2006.01) |
| ***C22C 38/02*** | (2006.01) |
| ***C22C 38/12*** | (2006.01) |
| ***C22C 38/40*** | (2006.01) |
| ***C21D 8/10*** | (2006.01) |

(52) U.S. Cl.

CPC ..... *C21D 9/085* (2013.01); *B21B 19/04* (2013.01); *C21D 1/18* (2013.01); *C21D 1/667* (2013.01); *C21D 6/005* (2013.01); *C21D 6/008* (2013.01); *C21D 9/08* (2013.01); *C21D 11/005* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/40* (2013.01); *C21D 8/10* (2013.01); *C21D 8/105* (2013.01); *C21D 2211/002* (2013.01); *C21D 2211/003* (2013.01); *C21D 2211/005* (2013.01); *C21D 2211/008* (2013.01); *C21D 2211/009* (2013.01)

(58) Field of Classification Search

CPC ..... B21B 19/04; C21D 1/18; C21D 1/667; C21D 6/005; C21D 6/008; C21D 9/08; C21D 9/085; C21D 11/005; C21D 8/10; C21D 8/105; C22C 38/002; C22C 38/02; C22C 38/04; C22C 38/06; C22C 38/08; C22C 38/12; C22C 38/40

USPC ..... 148/593

See application file for complete search history.

(56) References Cited

U.S. PATENT DOCUMENTS

| | | | |
|---|---|---|---|
| 2008/0121318 | A1 | 5/2008 | Arai et al. |
| 2012/0042992 | A1 | 2/2012 | Kondo et al. |

FOREIGN PATENT DOCUMENTS

| | | | |
|---|---|---|---|
| CN | 1502425 | A | 6/2004 |
| CN | 1951589 | A | 4/2007 |
| CN | 101157096 | A | 4/2008 |
| CN | 101928889 | A | 12/2010 |
| CN | 102365376 | A | 2/2012 |
| CN | 102618791 | A | 8/2012 |
| CN | 104831175 | A | 8/2015 |

(Continued)

OTHER PUBLICATIONS

ASM datasheet for 4130/4135/4137, 33CrMo4, DIN. 2018. (Year: 2018).*

(Continued)

*Primary Examiner* — Brian D Walck

(74) *Attorney, Agent, or Firm* — Neal, Gerber & Eisenberg LLP

(57) ABSTRACT

An process for the on-line quenching of seamless steel tube using residual heat, a method for manufacturing a seamless steel tube, and a seamless steel tube. The process for the on-line quenching of a seamless steel tube comprises the following steps: when the temperature of a tube is higher than Ar3, evenly spraying water along a circumferential direction of the tube so as to continuously cool the tube to be not higher than T° C., the cooling rate being controlled to be E1° C./s to E2° C./s to obtain a microstructure with martensite as the main composition, wherein T=Ms−95° C., Ms represents the martensitic phase transition temperature, E1=20×(0.5−C)+15×(3.2−Mn)−8×Cr−28×Mo−4×Ni−2800×B, and E2=96×(0.45−C)+12×(4.6−Mn), and the C, Mn, Cr, Ni, B and Mo in the equations each represents the mass percentages of corresponding elements in the seamless steel tube.

7 Claims, No Drawings

(56) References Cited

FOREIGN PATENT DOCUMENTS

| | | | |
|---|---|---|---|
| CN | 105039863 | | 11/2015 |
| CN | 105154765 | A | 12/2015 |
| JP | 2007031756 | A | 2/2007 |
| JP | 2008266700 | A | 11/2008 |

OTHER PUBLICATIONS

Canale et al. "Problems Associated with Heat Treating." ASM Handbook, vol. 4B, Steel Heat Treating Technologies. pp. 29-73. 2014. (Year: 2014).*

Feng, Xuejun et al., "Practice of on-line Water quenching Heat treatment for Steel Tubes", Tianjin Metallurgy, Dec. 31, 2005, No. 129, pp. 44-46.

Tao, Xuezhi et al., "On-line Heat Treatment Process for Steel Pipe with Water Quenching", Steel Pipe, Apr. 30, 2006, vol. 35, No. 2, 5 pages.

Van Bohemen, SMC , "Bainite and martensite start temperature calculated with exponential carbon dependence", Materials Science and Technology, 2012, vol. 28(4), pp. 487-495, abstract only.

* cited by examiner

PROCESS FOR ON-LINE QUENCHING OF SEAMLESS STEEL TUBE USING RESIDUAL HEAT AND MANUFACTURING METHOD

CROSS-REFERENCE TO RELATED APPLICATION

This application is a national stage entry pursuant to 35 U.S.C. § 371 of International Application No. PCT/CN2016/099563, filed on Sep. 21, 2016, which claims priority to Chinese Patent Application No. 201510615737.9, filed on Sep. 24, 2015, Chinese Patent Application No. 201610265674.3, filed Apr. 26, 2016, and Chinese Application No. 201610776283.8, filed Aug. 30, 2016, the contents of all of which are fully incorporated herein by reference.

FIELD

The present invention relates to a cooling process of steel tube and manufacturing method thereof, in particular to a cooling process of a seamless steel tube and a manufacturing method thereof.

BACKGROUND

In the prior art, due to product shape and manufacturing method limitations for hot-rolled seamless steel tubes, the product performance has long been improved only by addition of alloying elements and off-line heat treatment after rolling. Taking oil well tubes, for example, tubes having a degree of 555 MPa (80 Ksi) or higher requires addition of more alloying elements in manufacturing, which significantly increases the manufacturing cost. Or, tubes having a degree of 555 MPa (80 Ksi) or higher can be produced by off-line quenching heat treatment, wherein the so-called off-line quenching heat treatment means that hot-rolled seamless steel tubes are air-cooled to the room temperature after rolling, and be put into a tube bank firstly, then the pipes are heat-treated as needed. However, this method brings not only a waste of residual heat after rolling (the temperature of the steel tube after rolling is usually above 900° C.), but also a complexity of process and an increased cost. Furthermore, the tubes cannot be strengthened by off-line heat treatment using the induced phase transition effect after material deformation. According to the research, when the steel after the deformation is immediately on-line quenched, its performance is significantly higher than that of tube that is reheated and quenched after cooling.

As described above, although the skilled in the art has known that on-line quenching helps to make the seamless steel tube a better performance, the on-line quenching is still not used in the prior art. This is because the seamless steel tube, different from ordinary hot rolled steel tube, has its special section shape and has more complicated internal stress state than that of plate. If the on-line quenching process is adopted, it is difficult to control the performance steadily, and on the other hand the steel tube is likely to crack.

Invention Contents

One purpose of the present invention is to provide a cooling process for on-line quenching of seamless steel tube using residual heat, which can obtain seamless steel tube with better performance without adding large amount of alloying elements, and can prevent cracking of seamless steel tube effectively.

Based on the above invention purpose, the present invention provides a process for on-line quenching of seamless steel tube using residual heat, comprising the following steps:

when the temperature of tube is higher than Ar3, evenly spraying water along the circumferential direction of the tube so as to continuously cool the tube to be not higher than T° C., the cooling rate being controlled from E1° C./s to E2° C./s to obtain a microstructure with martensite as the main composition, wherein T=Ms−95° C., Ms represents the martensitic phase transition temperature, $E1=20\times(0.5-C)+15\times(3.2-Mn)-8\times Cr-28\times Mo-4\times Ni-2800\times B$, $E2=96\times(0.45-C)+12\times(4.6-Mn)$, C, Mn, Cr, Ni, B and Mo in the equations each represent the mass percentage of corresponding elements of the seamless steel tube.

It should also be noted that, the technical solution above defines the above formula does not mean that the seamless steel tube must contain elements of C, Mn, Cr, Ni B and Mo at the same time. The equations are general and can be applied to the seamless steel tube quenched by this method. Therefore, when one or more of the elements involved in the equations is not contained, zero should substitute into the equations.

In the process for the on-line quenching of seamless steel tube using residual heat according to the present invention, the inventor of the present invention control the cracking tendency effectively of the quenched seamless steel tube by controlling the matching relationship between the material of the steel pipe and the parameters of quenching process, in particular, the quenching start cooling temperature, the final cooling temperature and the cooling rate, which will obtain a higher ratio of martensitic phase after quenching, so as to achieve the stable controlling of the final performance of seamless steel tube.

More specifically, the inventor, after extensive research, creatively proposed that continuous cooling the tube to the temperature to be not higher than T° C. and controlling the cooling speed from E1° C./s to E2° C./s, wherein T=Ms−95° C., Ms represents the martensitic phase transition temperature $E1=20\times(0.5-C)+15\times(3.2-Mn)-8\ Cr-28\times Mo-4\times Ni-2800\times B$, $E2=96\times(0.45-C)+12\times(4.6-Mn)$, wherein C, Mn, Cr, Ni, B and Mo in the equations each represent the mass percentage of corresponding elements of the seamless steel tube. The cooling rate being controlled from E1° C./s to E2° C./s, which is because, when the cooling rate is less than E1, the martensite will difficult be obtained sufficiently in phase ratio after quenching, and thus cannot guarantee the final performance. When the cooling rate is higher than E2° C./s, will result to crack of seamless steel tube due to internal stress being larger after quenching In addition, the temperature of the tube needs to be higher than the Ar3 temperature, this is because some proeutectoid ferrite forms in the seamless steel tube if the process for the on-line quenching of seamless steel tube begins at a temperature below Ar3, which cannot guarantee to obtain the amount of martensite after quenching.

It should be noted that the Ar3 temperature and the Ms temperature is known to those skilled in the art or can be obtained under technical conditions. For example, it can be obtained by referring to a manual or by thermal simulation experiment.

In addition, it should be noted that, in the above equations, C, Mn, Cr, Ni B and Mo each represents the mass percentages of corresponding elements of the seamless steel tube. That is, the numerical values of C, Mn, Cr, Ni B and Mo substituted into the equations are the numerical values before the percent %. For example, in one embodiment where C is 0.17% by mass, the substituted value of C into the equations is 0.17, rather than 0.0017. The substitution of other elements has same meaning and is not further described.

Further, process for the on-line quenching of seamless steel tube according to the present invention, the total amount of alloying elements of the seamless steel tube is not more than 5% by mass, wherein the alloying elements are at least one selected from C, Mn, Cr, Mo, Ni, B, Cu, V, Nb and Ti. If the alloying elements of the seamless steel tube exceed 5% by mass, the martensitic transformation can be carried out in air cooling conditions without using this method. In addition, the alloying element of the seamless steel tube in the present technical solution is not limited to C, Mn, Cr, Mo, Ni, B, Cu, V, Nb and Ti, and may be other alloying elements.

Further, in the process for the on-line quenching of seamless steel tube according to the present invention, the total amount of alloying elements of the seamless steel tube is 0.2% to 5% by mass.

Further, in the process for the on-line quenching of seamless steel tube according to the present invention, the phase ratio of the obtained martensite is not less than 90%, which makes the seamless steel tube has high strength and toughness, and stable performance fluctuations.

Further, the obtained microstructure by the process for the on-line quenching of seamless steel tube according to the present invention may further contain bainite, ferrite and carbide.

Compared with the prior art, the said process for the on-line quenching of seamless steel tube of the preset invention utilizes the residual heat induced the phase transition effect of the steel material after deformation, thus, does not require to add excessive alloying elements. In addition, since the formula proposed in the technical solution has high applicability, the technical solution does not specifically limit the composition ratio of the seamless steel tube. As long as the technical features defined by the technical solutions are satisfied, the technical effects can be realized by the technical solutions.

Accordingly, another purpose of the present invention is to provide a method for manufacturing a seamless steel tube using residual heat, comprising the following steps:

(1) manufacturing the billet:

(2) forming the billet into tube:

(3) cooling the tube by the process for the on-line quenching of seamless steel tube; and (4) tempering.

It should be noted that, in step (1), the billet can be produced by casting the smelted molten steel into a round billet, or can be produced by pouring first and then forging or rolling the slab into the billet.

Further, in the method for manufacturing seamless steel tube according the present invention, in the step (4), the tempering temperature is not less than 400° C., the tempering time is not less than 30 min to ensure that the martensite can be sufficiently decomposed to obtain the tempered sorbite, so as to get better performance of seamless steel tube.

Further, in the manufacturing method for a seamless steel tube according to the present invention, in step (2), the billet is heated to 1100 to 1130° C. and maintained for 1 to 4 hours, followed by piercing, successive rolling, diameter reducing or sizing by tension, so as to obtain the tube.

In addition, another purpose of the present invention is to provide a seamless steel tube which is prepared by the method said above for manufacturing seamless steel tube.

Further, in the seamless steel tube of the present invention, the hardness thereof is higher than (58×C+27) HRC, said C represents the mass percentage of carbon in the seamless steel tube.

The process for the on-line quenching of seamless steel tube using residual heat and the method for manufacturing a seamless steel tube according to the present invention have the following advantages and beneficial effects:

(1) The process for the on-line quenching of seamless steel tube using residual heat and the method for manufacturing a seamless steel tube according to the present invention can make full use of the residual heat after the hot rolling of the seamless steel tube without reheating to make the seamless steel tube austenitized, which has a shorter production process and lower cost compared with the products obtained by off-line quenching in the prior art, (2) The process for the on-line quenching of seamless steel tube using residual heat and the method for manufacturing a seamless steel tube according to the present invention can effectively improve the toughness of the steel pipe and greatly reduce the amount of addition of the alloying elements at the same performance level.

(3) The process for the on-line quenching of seamless steel tube using residual heat and the method for manufacturing a seamless steel tube according to the present invention can avoid the cracking phenomenon of seamless steel tube which is unavoidable in the prior art and ensure the qualified rate of the product.

(4) The process for the on-line quenching of seamless steel tube using residual heat and the method for manufacturing a seamless steel tube according to the present invention can obtain the microstructure of the seamless steel tube composed mainly by martensite, thereby ensuring the toughness and stability of the steel pipe.

DETAILED DESCRIPTION

The process for the on-line quenching of seamless steel tube using residual heat and the method for manufacturing a seamless steel tube according to the present invention will be further explained and described accompanying drawings and the specific Example as follow, and the this explanation and description shall not be deemed to limit to the technical solution of the present invention.

Examples A1-A7 and Comparative Examples B1-B5

The seamless steel tubes of the above Examples A1 to A7 were obtained by the following steps:

(1) Manufacturing the billet: smelting according to the mass percentage of each chemical element listed in Table 1, casting it into an ingot and forging the ingot into the billet.

(2) forming the billet into tube: the billet is heated to 1100° C. to 1130° C. and maintained for 1 to 4 hours, followed by piercing, rolling, stretch reducing or sizing, so as to obtain the tube.

(3) use the process for the on-line quenching of seamless steel tube using residual heat: when the temperature of tube is higher than Ar3, evenly spraying water along the circumferential direction of the tube so as to continuously cool the tube to be not higher than T° C., the cooling rate being controlled from E1° C./s to E2° C./s to obtain a microstructure with martensite as the main composition, wherein T=Ms−95° C., Ms represents the martensitic phase transition temperature, $E1=20\times(0.5-C)+15\times(3.2-Mn)-8\times Cr-28\times Mo-4\times Ni-2800\times B$. $E2=96\times(0.45-C)+12\times(4.6-Mn)$, C, Mn, Cr, Ni, B and Mo in the equations each represent the mass percentage of corresponding elements of the seamless steel tube.

(4) tempering: the tempering temperature is not less than 400° C., the tempering time is not less than 30 min.

In order to demonstrate the implementation effect of the online-control cooling process of the present invention, the process steps of manufacturing the billet and the tube for Comparative Example B1-B5 are the same as that for Example of the invention, whereas the process parameters of control cooling process for Comparative Example B1-B5 are outside the protection scope of the present technical solution. In addition, the treatment of the tube in the Comparative Example is not the on-line quenching, but completely cooled to room temperature and then heated to Ar3 and then began to quench.

Table 1 lists each mass percentage of the chemical elements of the seamless steel tubes of Examples A1 to A7 and Comparative Examples B1 to B5.

TABLE 1

(wt %, the margin is Fe and other unavoidable impurity elements)

| No. | Steel model | C | Mn | Cr | Mo | B | Ni |
|---|---|---|---|---|---|---|---|
| A1 | 16Mn | 0.17 | 1.65 | — | — | — | |
| A2 | 20Mn2 | 0.2 | 1.6 | — | — | — | |
| A3 | 20Mn2 | 0.2 | 1.6 | — | — | — | |
| A4 | 30CrMo | 0.3 | 0.45 | 1.05 | 0.23 | — | |
| A5 | 30CrMo | 0.3 | 0.45 | 1.05 | 0.23 | — | |
| A6 | 20Mn2B | 0.21 | 1.64 | — | — | 0.0025 | |
| A7 | 20CrNi | 0.2 | 0.55 | 0.9 | — | — | 1.05 |
| B1 | 20Mn2 | 0.2 | 1.6 | — | — | — | |
| B2 | 20Mn2 | 0.2 | 1.6 | — | — | — | |
| B3 | 20Mn2 | 0.2 | 1.6 | — | — | — | |
| B4 | 20Mn2 | 0.2 | 1.6 | — | — | — | |
| B5 | 30CrMo | 0.3 | 0.45 | 1.05 | 0.23 | — | |

Table 2 lists the specific process parameters for the methods for manufacturing seamless steel tube of Examples A1-A7 and Comparative Examples B1-B5.

TABLE 2

| No. | Heating temperature (° C.) | heating time (h) | Ar3 temperature (° C.) | Start cooling temperature (° C.) | Ms (° C.) | T (° C.) | Final cooling temperature (° C.) | E1 (° C./s) | E2 (° C./s) | Cooling rate (° C./s) | The phase ratio of the martensite after quenching (%) | tempering temperature (° C.) | tempering time (min) |
|---|---|---|---|---|---|---|---|---|---|---|---|---|---|
| A1 | 1150 | 1.4 | 835 | 930 | 410 | 315 | 220 | 29.85 | 62.28 | 61 | 94 | 500 | 60 |
| A2 | 1250 | 2.5 | 740 | 920 | 400 | 305 | 290 | 30 | 60 | 42 | 96 | 450 | 45 |
| A3 | 1200 | 2 | 740 | 880 | 400 | 305 | 120 | 30 | 60 | 38 | 98 | 550 | 50 |
| A4 | 1280 | 2.8 | 763 | 960 | 345 | 250 | 190 | 30.41 | 64.2 | 34 | 92 | 620 | 70 |
| A5 | 1140 | 3.5 | 763 | 830 | 345 | 250 | 200 | 30.41 | 64.2 | 44 | 95 | 640 | 80 |
| A6 | 1260 | 2.5 | 736 | 970 | 270 | 175 | 160 | 22.2 | 58.56 | 36 | 93 | 660 | 35 |
| A7 | 1220 | 3 | 750 | 920 | 410 | 315 | 265 | 48.75 | 72.6 | 64 | 96 | 580 | 45 |
| B1 | 1250 | 2 | 740 | 725 | 400 | 305 | 100 | 30 | 60 | 48 | 42 | 500 | 60 |
| B2 | 1250 | 2 | 740 | 860 | 400 | 305 | 250 | 30 | 60 | 24 | 38 | 450 | 60 |
| B3 | 1250 | 2 | 740 | 940 | 400 | 305 | 380 | 30 | 60 | 46 | 26 | 550 | 60 |
| B4 | 1250 | 2 | 740 | 800 | 400 | 305 | 180 | 30 | 60 | 66 | — | | |
| B5 | 1250 | 2 | 763 | 890 | 345 | 250 | 160 | 30.41 | 64.2 | 70 | — | | |

Various performance tests were conducted on the seamless steel tubes of Example A1-A7 and Comparative Example B1-B5, and the results are shown in Table 3. Wherein the yield strength data are average value obtained according to the API standard after the seamless steel tube of Example A1-A7 and the seamless steel tube of Comparative Example B1-B6 are processed into API arc-shaped samples. The impact sample was test by the standard impact sample of the seamless steel tube of Example A1-A7 and Comparative Example B1 to B6 processed into 10 mm*10 mm*55 mm size, V-notch at 0° C. In addition, the hardness after quenching cooling of each Example and Comparative Example was measured by a Rockwell hardness test.

Table 3 lists the seamless steel tube performance data for each of the Examples and Comparative Examples.

| No. | HRC hardness after quenching | Crack/ yes or no | Yield Strength Rp0.2 (MPa ) | Impact energy (full size sample) at 0° C. (J) |
|---|---|---|---|---|
| A1 | 39 | no | 492 | 185 |
| A2 | 42 | no | 785 | 106 |
| A3 | 44 | no | 645 | 118 |
| A4 | 46 | no | 798 | 162 |
| A5 | 49 | no | 762 | 177 |
| A6 | 43 | no | 606 | 154 |
| A7 | 42 | no | 672 | 148 |
| B1 | 35 | no | 421 | 167 |
| B2 | 33 | no | 596 | 98 |
| B3 | 33 | no | 568 | 112 |
| B4 | — | yes | — | — |
| B5 | — | yes | — | — |

As can be seen from Table 2, the phase ratio of martensite of the seamless steel tubes for all Examples A1-A7 is ≥90% after the on-line quenching. As can be seen from Table 3, the yield strength of the seamless steel tubes for Examples A1-A7 is ≥492 MPa, the impact energy at 0° C. thereof are all higher than 106J. and the hardness of HRC after quenching are higher than 39, and there is no creaking.

As can be seen from Table 2 and Table 1, the component ratios of the chemical elements for all Example and Comparative Example have no difference, but the method for manufacturing of the Example and Comparative Example are significantly different. Therefore, the performance of the seamless tube of Example A1-A7 is superior to that of Comparative Example B1-B6 overall. In addition, as can be seen from Table 2 and Table 3, the quenching starting temperature of Comparative Example B1 is lower than the Ar3 temperature so that the steel of Comparative Example B1 precipitates proeutectoid ferrite, reducing its hardness after quenching and affecting the strength of seamless steel tube also. The cooling rate of Comparative Example B2 is lower than the cooling rate range defined in the present technical solution, and the final cooling temperature of Comparative Example B3 was higher than the T° C. of the present invention, thus the desired microstructure with high ratio of martensite of seamless steel tube could not be obtained in Comparative Example B2 and B3, which will affect the performance. In addition, the cooling rate of Comparative Example B4 is higher than the cooling rate range defined in the present technical solution, so that the steel tube cracked, and no suitable steel tube can be obtained.

It is to be noted that the above Example are only a specific embodiments of the present invention. Apparently, the invention is not limited to the above embodiments, and there are may be many similar variations. A person skilled in the art can directly derive or associate all the variations from the content disclosed by the invention, all of which shall be covered by the protection scope of the invention.

The invention claimed is:

1. A process for the on-line quenching of seamless steel tube using residual heat, consisting of the following steps:

cooling the tube when the temperature of tube is higher than Ar3 by spraying water evenly along the circumferential direction of the tube so as to continuously cool the tube to be at least 120° C. but not higher than a threshold temperature that is 95° C. less than the martensitic phase transition temperature, ceasing cooling before the tube reaches a temperature of lower than 120° C., wherein the cooling rate is controlled to be between a range of E1° C./s and E2° C./s that is based on the mass percentage of corresponding elements of the seamless steel tube to obtain a microstructure with martensite as the main composition, wherein $$E1=20\times(0.5-C)+15\times(3.2-Mn)-8\times Cr-28\times Mo-4\times Ni-2800\times B,$$

$$E2=96\times(0.45-C)+12\times(4.6-Mn),\text{ and}$$

wherein C, Mn, Cr, Ni, B and Mo in the equations each represent the mass percentage of corresponding elements of the seamless steel tube, and wherein the seamless steel tube comprises the following composition by mass percentage:

C: 0.17%-0.3%, Mn: 0.45%-1.65%, Cr: 0-1.05%, Mo: 0-0.23%, B: 0-0.0025%, and Ni: 0-1.05%.

2. The process for the on-line quenching of seamless steel tube according to claim 1, wherein the total amount of alloying elements of the seamless steel tube is not more than 5% by mass, said alloying elements being at least one selected from C, Mn, Cr, Mo, Ni, Cu, V, Nb and Ti.

3. The process for the on-line quenching of seamless steel tube according to claim 2, wherein the total amount of alloying elements of the seamless steel tube is 0.2% to 5% by mass.

4. The process for the on-line quenching of seamless steel tube according to claim 1, wherein the phase ratio of martensite is not less than 90%.

5. A method for manufacturing a seamless steel tube using residual heat, comprising the following steps:

(1) manufacturing the billet;

(2) forming the billet into tube;

(3) cooling the tube by the process for the on-line quenching of seamless steel tube according to claim 1; and (4) tempering.

6. The method for manufacturing seamless steel tube according to claim 5, wherein in the step (4), the tempering temperature is not less than 400° C., the tempering time is not less than 30 min.

7. The method for manufacturing seamless steel tube according to claim 5, wherein in the step (2), the billet is heated to 1100° C. to 1300° C., maintained for 1-4 hours, followed by piercing, successive rolling, stretch reducing or sizing, so as to obtain the tube.

* * * * *